United States Patent [19]

Minerbe

[11] 4,198,761

[45] Apr. 22, 1980

[54] FORCED BLOWING METHOD FOR FLUIDS ENABLING THERMAL EXCHANGES WITHIN A MOVING MASS OF MATERIAL PLACED IN A ROTATING CYLINDER

[75] Inventor: Michel A. R. Minerbe, Sartrouville, France

[73] Assignee: Societe pour la Recherche, l'Etude et Mise au Point de Tous Brevets, S.O.R.E.B., Mantes-la-Jolie, France

[21] Appl. No.: 898,493

[22] Filed: Apr. 20, 1978

[51] Int. Cl.[2] ..... F26B 3/08; F26B 7/00

[52] U.S. Cl. ..... 34/10; 34/20; 432/80

[58] Field of Search ..... 432/80, 109; 34/20, 34/135, 10

[56] References Cited

U.S. PATENT DOCUMENTS

| | | | |
|---|---|---|---|
| 1,071,303 | 8/1913 | Dreisbach et al. | 432/109 |
| 1,216,667 | 2/1917 | Downs | 34/135 |
| 2,029,873 | 2/1936 | Jonsson | 34/20 X |
| 2,073,994 | 3/1937 | Queneau | 34/135 |
| 2,091,850 | 8/1937 | Gohre | 432/109 |
| 2,483,738 | 10/1949 | Petersen | 432/80 |
| 2,941,791 | 6/1960 | Wienert | 432/109 |
| 3,171,723 | 3/1965 | Hansen | 34/135 |
| 3,661,370 | 5/1972 | Rossi | 432/109 |

*Primary Examiner*—John J. Camby
*Attorney, Agent, or Firm*—Young & Thompson

[57] ABSTRACT

The invention relates to a method to promote the physical or chemical exchanges in a moving mass of material contained in a rotating exchanger. A gaseous or liquid fluid which may be combustible or not, is forced through the said mass in movement by injecting the said fluid within the said moving material by means of a system of variable flow injectors passing through the wall of the rotating exchanger.

1 Claim, 3 Drawing Figures

FORCED BLOWING METHOD FOR FLUIDS ENABLING THERMAL EXCHANGES WITHIN A MOVING MASS OF MATERIAL PLACED IN A ROTATING CYLINDER

The present invention has for its object, by means of a forced blowing of gaseous or liquid fluids, which are combustible or not, to permit thermal, physical or chemical exchanges within a moving material contained in a cylindrical rotating exchanger, such as an oven, a dryer, a cooler and so on.

We shall more particularly describe the method when thermal exchanges are used to cool with air a material such as clinker coming out of a rotary oven.

Now the main cooling systems are:

1. rotary cooling
2. netting cooling
3. satellite cooling, comprising a ring of cylinders placed outside the oven In 1 and 3 the air circulates by convection under the effect of the aspiration of the chimney or of the exhaust fan of the oven.

In 2, the air is blown under the netting of the cooler.

All these cooling systems have the aim on the one hand to cool the moving material, the clinker in a cement oven, to a sufficient extent to permit its handling, and on the other hand to recuperate the heat by raising the temperature of the cooling air, facilitating its restitution, if necessary, at the appropriate place.

In cases 1 and 3 the contact of the air occurs only at the surface of the layer of material, the rotating device producing a continuous stirring of the material.

In the case 2, the contact of the air is through the whole layer of material but the netting or grills of different types having a continuous or alternate movement do not favour the formation of a layer of constant thickness being regularly stirred. The cooling air tends to pass at the locations where the layer of material is less thick; the material is therefore cooled in a non homogeneous way and therefore an excessive air volume is required.

In all the cases the loss of energy is important.

The novelty in the present invention consists in a method for passing the air through the moving material which is regularly stirred in a rotative system.

The method seeks, by forced blowing of a combustible or in combustible, gaseous or liquid fluid, to permit thermal exchanges in the moving material contained in a rotating cylindrical exchanger, such as an oven, a dryer, a cooler and so on.

It comprises injectors passing through the wall of a rotating exchanger, blowing through the moving material gaseous or liquid fluids, which can be combustible or not, the flow rate of which is regulated by remote controlled valves. The fluids are fed to the injectors by means of tubes fastened to the rotating exchanger. The tubes are fed with air, by one or more motorized fan assemblies, fixed outside of the rotating wall, the necessary electrical power being delivered by means of conducting rings connected to the exchanger and sliding on stationary contacts. In a more general case the feeding of gaseous or liquid fluids which are combustible or not, can be effected by a pipe coaxial with the rotating exchanger, and connected by a rotary joint.

This invention applies to existing coolers but can also be adapted to the down stream part, widened or not, of rotating ovens such as cement ovens.

Figure 1:
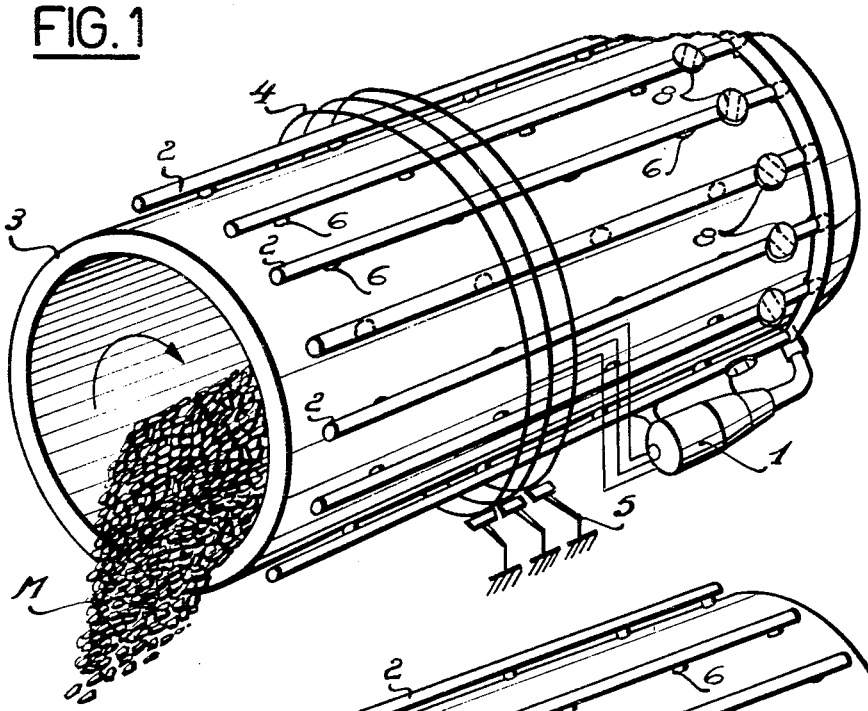
FIG. 1 shows a perspective view of the oven with fans rotating with the oven.

FIG. 1 shows the installation in perspective view. It comprises one or several fans 1 blowing the air from outside through a ring of pipes 2 fixed to the oven 3 and rotating with it. The fans 1 are driven by motors fed with electrical power by means of conducting rings 4 sliding on stationary contacts 5. The injectors 6 passing through the oven wall 3 are adequately distributed along the pipes 2 to blow air through the continuously moving material M owning to the rotation of the oven 3.

Figure 2:
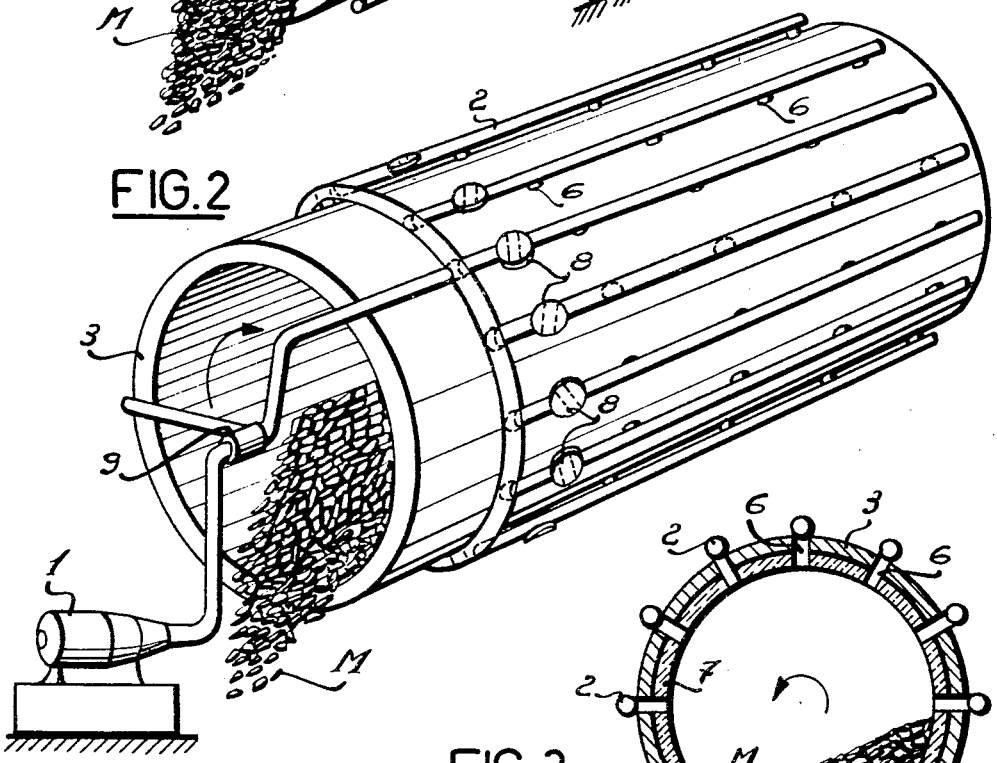
FIG. 2 shows a perspective view of the oven with the fan fixed outside of the oven.
Figure 3:
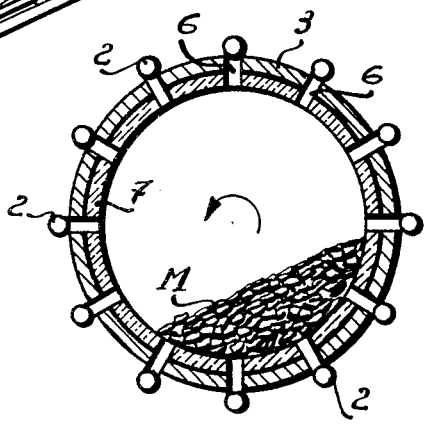
FIG. 3 is a sectional view of the oven.

FIG. 3 shows a section of the oven 3. One sees there the injectors 6 passing through the wall of the oven and its inside lining 7. The injectors 6 have to blow air through the moving material M, such as clinker in a cement oven. This flow rate is regulated by a system of remote controlled valves 8 in the air feeding pipes. These valves have to control the necessary air quantity within the moving material, depending on the desired thermal exchange. It is to be noted that the fans may be mounted on the rotating oven or not. When the fans are fixedly installed, the feeding of air to the conduits feeding the injectors may be realized by a feeding duct placed coaxially with the oven, rotatably sealed by a rotating joint 9, such as shown in FIG. 2.

This method may be used not only as described for cooling a moving material in the down stream part, widened or not, of a cylindrical rotating oven, such as a cement oven, but may be applied also to the cooling of any material in movement within a rotating cylinder.

It may also, by the use of burnable or not, gaseous or liquid fluids, enable any physical or chemical exchange between the fluids and the moving material within a rotating exchanger such as for drying, heating, reduction or oxidation.

In the case of other fluids than air, their feeding to the injectors can be conducted:

in a continuous way, by means of a rotating joint (see FIG. 2).

from a container connected in a permanent way or not to the rotating exchanger.

(a) In the case where the container is permanently connected its feeding (for example with water, fuel, non volatile liquids generally) will be effected by pumping the liquid with a radial pipe rotating with the rotating exchanger and dipping during the lower part of its trajectory in a sump located on the bottom and containing the liquid. The necessary suction will be produced by a pump connected to the rotating exchanger as will also the pressurizing of the container, the electrical power being delivered by the conducting rings.

(b) In the case of gaseous or volatile liquid (propane, butane, carbon dioxide) they are pressurized in containers which will be mounted, and taken away when empty, on the outside wall of the rotating exchanger by means of appropriate automatic mechanical systems.

What I claim is:

1. In a method of promoting physical or chemical exchanges in a moving mass of material contained in a cylindrical chamber that rotates about its axis, in which a fluid is fed to an annular manifold that extends about the chamber and fluid from the manifold is conveyed through a plurality of conduits that extend from the manifold and that are parallel to each other and to the axis of the chamber and are carried by the outside of the chamber, and in which said fluid is drawn from said conduits at a plurality of points spaced apart along the length of each conduit and introduced through the cylindrical wall of the chamber and into the interior of the chamber; the improvement comprising regulating the flow of said fluid by controllably adjusting said flow in each said conduit at a point disposed between said manifold and the said point most closely adjacent said manifold, whereby the regulation at each said point serves simultaneously to regulate the flow of said fluid through all said points along the associated conduit, independently of the flow in the other said conduits.

* * * * *